US008878462B2

(12) United States Patent
Krummel

(10) Patent No.: US 8,878,462 B2
(45) Date of Patent: Nov. 4, 2014

(54) CIRCUIT ARRANGEMENT AND METHOD FOR OPERATING AT LEAST ONE DISCHARGE LAMP

(75) Inventor: Peter Krummel, Traunreut (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 646 days.

(21) Appl. No.: 13/169,154

(22) Filed: Jun. 27, 2011

(65) Prior Publication Data

US 2012/0007515 A1 Jan. 12, 2012

(30) Foreign Application Priority Data

Jul. 12, 2010 (DE) ..... 10 2010 031 219

(51) Int. Cl.
*H05B 41/38* (2006.01)
*H05B 41/392* (2006.01)
*H05B 41/298* (2006.01)

(52) U.S. Cl.
CPC ..... *H05B 41/2988* (2013.01); *H05B 41/3921* (2013.01); *Y10S 315/04* (2013.01)
USPC ..... 315/309; 315/200 R; 315/209 R; 315/291; 315/308; 315/DIG. 4

(58) Field of Classification Search
CPC ..... H05B 37/02; H05B 41/00; H05B 41/14; H05B 41/2833; H05B 41/2928; H05B 41/3921; H05B 41/36; H05B 41/38; H05B 41/3927
USPC ..... 315/200 R, 209 R, 224, 226, 291, 307, 315/309, DIG. 4, DIG. 7
See application file for complete search history.

(56) References Cited

U.S. PATENT DOCUMENTS

| | | | | |
|---|---|---|---|---|
| 5,066,894 | A | 11/1991 | Klier | |
| 5,170,099 | A | 12/1992 | Ueoka et al. | |
| 5,770,924 | A | 6/1998 | Osterried et al. | |
| 5,773,937 | A * | 6/1998 | Miyazaki et al. | 315/246 |
| 5,914,572 | A * | 6/1999 | Qian et al. | 315/307 |
| 7,973,493 | B2 | 7/2011 | Onishi et al. | |
| 2003/0011326 | A1 | 1/2003 | Noh | |
| 2010/0013393 | A1 * | 1/2010 | Onishi et al. | 315/119 |

FOREIGN PATENT DOCUMENTS

| | | | |
|---|---|---|---|
| CN | 101513129 | A | 8/2009 |
| DE | 690 19 862 | T2 | 11/1995 |
| DE | 10138153 | A1 | 2/2003 |
| DE | 10 2006 043 155 | A1 | 3/2008 |
| EP | 0 422 255 | B1 | 3/1994 |
| EP | 0732869 | B1 | 7/2001 |

OTHER PUBLICATIONS

English language abstract for DE 10 2006 043 155 A1.
Office Action issued in the corresponding Chinese application No. 201110193086.0 dated Jun. 5, 2014 with its English translation.

* cited by examiner

*Primary Examiner* — Douglas W Owens
*Assistant Examiner* — Thai Pham

(57) ABSTRACT

Various embodiments relate to a circuit arrangement for operating at least one discharge lamp. In order to prevent intrinsic flicker at low dimming settings and low temperatures, according to various embodiments, a direct current which is fed into the discharge lamp so as to avoid striated discharges at relatively high dimming settings is reduced or entirely eliminated.

17 Claims, 3 Drawing Sheets

CIRCUIT ARRANGEMENT AND METHOD FOR OPERATING AT LEAST ONE DISCHARGE LAMP

CROSS-REFERENCE TO RELATED APPLICATION

This application claims priority to German Patent Application Serial No. 10 2010 031 219.3, which was filed Jul. 12, 2010, and is incorporated herein by reference in its entirety.

TECHNICAL FIELD

Various embodiments relate to a circuit arrangement and a method for operating at least one discharge lamp.

BACKGROUND

Various embodiments relate to a problem which occurs during operation of discharge lamps using dimmable electronic ballasts. In this case, so-called striated discharges occur at some dimming settings. A known and conventional solution is to suppress these striated discharges by feeding a direct current into the discharge lamp.

In this context, it is known that unstable gas discharges may occur at low dimming settings and at relatively low ambient temperatures, for example temperatures below 20° C., said unstable gas discharges becoming noticeable by virtue of chaotic light flicker which is only slight but nevertheless becomes disruptive at such a low light level. This effect is known by the term so-called intrinsic flicker. This does not occur in all discharge lamps; for example discharge lamps whose gas fill contains a krypton component do not demonstrate such a behavior. The actual cause for this intrinsic flicker has not yet been researched.

Until now, therefore, operating states in which the intrinsic flicker occurs have not been permitted for the affected discharge lamps.

SUMMARY

Various embodiments relate to a circuit arrangement for operating at least one discharge lamp. In order to prevent intrinsic flicker at low dimming settings and low temperatures, according to various embodiments, a direct current which is fed into the discharge lamp so as to avoid striated discharges at relatively high dimming settings is reduced or entirely eliminated.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
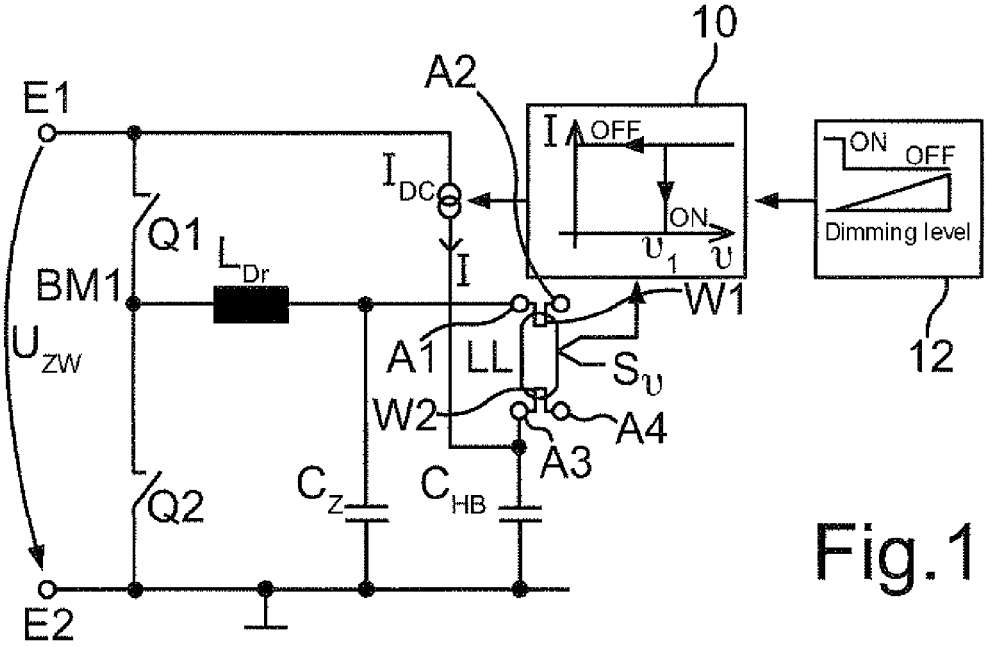
FIG. 1 shows a schematic illustration of a first embodiment of a circuit arrangement in accordance with various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

In the different embodiments of a circuit arrangement according to the invention illustrated in the figures, the same reference symbols have been used for identical and functionally identical component parts. Said reference symbols are therefore only introduced once, with the result that the details given can substantially be restricted to the differences with respect to the previously described embodiments.

Various embodiments provide a circuit arrangement for operating at least one discharge lamp with an input with a first input terminal and a second input terminal for coupling to a DC supply voltage, a bridge circuit with at least a first electronic switch and a second electronic switch, the first electronic switch and the second electronic switch being coupled in series between the first input terminal and the second input terminal so as to form a first bridge center point of the bridge circuit, and with at least one coupling capacitor, a first output terminal and a second output terminal for coupling to the high filament of the discharge lamp, a third output terminal and a fourth output terminal for coupling to the low filament of the discharge lamp, a lamp inductor, which is coupled in series between the first bridge center point and one of the output terminals for the high filament of the discharge lamp, and a direct current source, which is coupled to the discharge lamp. Furthermore, various embodiments provide a corresponding method for operating at least one discharge lamp using such a circuit arrangement.

Various embodiments develop a circuit arrangement or a method of the type mentioned at the outset in such a way that firstly striated discharges and secondly intrinsic flicker of the discharge lamp can be prevented as far as possible even at low dimming settings and at low ambient temperatures.

Various embodiments are based on the knowledge that, although feeding a direct current effectively prevents the striated discharges, precisely this direct current is the cause of the intrinsic flicker at low dimming settings and low ambient temperatures. According to various embodiments, therefore, the direct current fed into the discharge lamp is reduced in a suitable manner or eliminated entirely in order to prevent the intrinsic flicker at low dimming settings and low ambient temperatures.

By virtue of this procedure, the gas discharge can be stabilized and the intrinsic flicker largely prevented.

A circuit arrangement according to various embodiments therefore furthermore includes at least one sensor apparatus for detecting at least one operational parameter of the discharge lamp and a control apparatus, which is coupled to the at least one sensor apparatus and the direct current source, the control apparatus being designed to vary the amplitude of the direct current output by the direct current source depending on the at least one operational parameter detected by the at least one sensor apparatus.

In various embodiments, the circuit arrangement furthermore includes a dimming factor provision apparatus, which is designed to provide a signal at its output which is correlated with a dimming factor of the circuit arrangement, the dimming factor provision apparatus being coupled to the control apparatus, the control apparatus being designed to vary the amplitude of the direct current output by the direct current source depending on the dimming factor. In this case, it is possible to take into account the fact that the so-called intrinsic flicker occurs e.g. at dimming factors below 20%, e.g. below 15% of the maximum dimming factor. In this case, a dimming factor of 20% means that the discharge lamp now only outputs 20% of the light that it would output on full-load operation.

In various embodiments, therefore, the control apparatus is designed to vary the amplitude of the direct current output by the direct current source only when the dimming factor is in a predeterminable range. In other words, therefore, there is no reduction in the direct current supplied to the discharge lamp for avoiding striated discharges at dimming factors of above approximately 20%.

Provision can be made for a direct current with a predeterminable amplitude to be fed into the discharge lamp above a predeterminable dimming factor and for the supply of a direct current to be entirely dispensed with below this dimming factor. However, provision can also be made for the control apparatus to be designed to vary the amplitude of the direct current output by the direct current source to different extents depending on the dimming factor. In other words, according to this the direct current supplied to the discharge lamp is decreased continuously within the critical dimming factor range from high to low dimming factors.

In various embodiments, the direct current source is coupled between the first input terminal and one of the output terminals for the low filament of the discharge lamp. As a result, the coupling capacitor is precharged. The direct current therefore flows away from the cold, i.e. low, filament to the hot, i.e. high, filament and from there, via the lamp inductor and the low electronic switch, to ground.

Alternatively, it is also possible for the direct current source to be coupled between one of the output terminals for the low filament of the discharge lamp and a reference potential, in particular the second input terminal. If, therefore, the coupling capacitor is coupled between one of the output terminals for the low filament of the discharge lamp and the reference potential, the direct current source is virtually connected in parallel with this coupling capacitor. The current likewise flows away from the direct current source to the cold filament, from there, via the gas discharge, to the hot filament and then, via the lamp inductor and the low switch in the bridge circuit, to the reference potential.

Alternatively, the direct current source can be realized by adjusting the duty factor of the signals driving the switches in the bridge circuit. By virtue of an unbalanced duty factor, it is thus possible for a DC component to be generated and fed into the discharge lamp as direct current. This variant has the advantage that it is possible to dispense with the realization of an additional direct current source, and instead the supply of direct current to the discharge lamp can be achieved substantially by already existing components.

In various embodiments, the sensor apparatus represents a temperature sensor. In this case, the temperature sensor may be arranged with respect to the discharge lamp in such a way that the temperature sensor can be used to measure a temperature which is correlated with the temperature of the discharge lamp. In various embodiments, the temperature sensor is arranged in such a way that it can measure the temperature at the tube wall of the discharge lamp.

Furthermore, in this context, the control apparatus is designed to drive the direct current source in such a way that the amplitude of the direct current output by the direct current source is varied in accordance with a predeterminable characteristic stored in the control apparatus depending on the temperature. It goes without saying that this is only performed when the dimming factor provided by means of the dimming factor provision apparatus prompts this event.

In this case, the characteristic is designed in such a way that the control apparatus drives the direct current source in such a way that said direct current source outputs a direct current of a predeterminable amplitude at a temperature which is equal to or greater than a predeterminable threshold value, and does not output a direct current at a temperature below the predeterminable threshold value.

As an alternative to this binary solution, provision can be made for the characteristic to be designed in such a way that the control apparatus drives the direct current source in such a way that the amplitude of the direct current output thereby is reduced substantially continuously, e.g. below a predeterminable threshold value for the temperature, at relatively low temperatures, or is reduced in accordance with a large number of steps depending on the temperature.

The latter variant makes it possible in a particularly precise manner to avoid striated discharges, on the one hand, and to avoid intrinsic flicker, on the other hand.

Provision can also be made, for example in the form of a lookup table, to specify the direct current which is intended to be supplied to the discharge lamp for a large number of combinations of temperature and dimming factor.

As an alternative to the determination of the temperature, the sensor apparatus can be coupled to the at least one coupling capacitor, the sensor apparatus being designed to evaluate the voltage drop across the coupling capacitor. In this context, it is irrelevant where the coupling capacitor is arranged in the circuit arrangement. In this case, the sensor apparatus preferably includes the series circuit including a low-pass filter apparatus, an AC signal output apparatus and a rectifier.

In various embodiments, the limit frequency of the low-pass filter apparatus is from 200 to 300 Hz in order to detect, in a reliable manner, relevant AC signal components which indicate intrinsic flicker of the discharge lamp in the frequency range of between 20 and 150 Hz. Although this could result in system hum also being detected, this only occurs at high dimming levels. At low dimming levels at which the intrinsic flicker occurs, however, the system hum is negligible. This procedure is based on the knowledge that the intrinsic flicker of the discharge lamp can be established by the evaluation of the voltage at the coupling capacitor. As soon as the discharge lamp flickers, a superimposed AC voltage with a low frequency occurs at the coupling capacitor. This superimposed AC voltage can be used for the control, in particular even the closed-loop control, of the direct current source.

Therefore, the control apparatus may include a closed-loop control apparatus with a first input and a second input, the first input being coupled to the output of the rectifier, and the second input being coupled to a comparison value provision apparatus, the comparison value provision apparatus being designed to provide a comparison value, e.g. depending on the dimming factor, at its output, the control apparatus being designed to drive the direct current source in such a way that the amplitude of the direct current output by the direct current source is varied depending on the signal at the output of the closed-loop control apparatus. By virtue of the comparison value it is nevertheless possible to take account of the low component of the system hum which changes depending on the dimming setting.

In accordance with a first embodiment, in this case the closed-loop control apparatus can include an I controller. This embodiment has the advantage that the direct current is decreased only in the case of discharge lamps which demonstrate intrinsic flicker. In the case of discharge lamps which do not demonstrate any intrinsic flicker, the direct current is maintained within the total dimming and temperature range. However, direct current is only ever fed into the discharge lamp until the superimposed AC voltage corresponds to the predetermined comparison value. The closed-loop control apparatus therefore always functions at the stability limit.

In an alternative embodiment, therefore, the closed-loop control apparatus includes a two-state controller. Said two-state controller is designed in such a way that the process of increasing the amplitude of the direct current is characterized by a first time constant, and the process of decreasing the amplitude of the direct current is characterized by a second time constant, the first time constant representing a multiple of the second time constant, the first time constant being at least a factor of 1000, e.g. at least a factor of 10 000, greater than the second time constant. As a result, the direct current is reduced quickly, for example in the milliseconds range, when intrinsic flicker is established. Then, the direct current is increased again slowly, i.e. in the seconds to minutes range, until the intrinsic flicker just occurs again. The advantage of this variant consists in that, in the case of such a closed-loop control apparatus, the discharge lamp only ever comes into the intrinsic flicker state for a very short period of time and is then operated in the flicker-free state for a long period of time. The visual impression is therefore relatively steady operation of the discharge lamp in comparison with the operation of the discharge lamp at the stability limit.

The embodiments proposed with reference to the circuit arrangement and the advantages thereof apply correspondingly, insofar as applicable, to the method according to various embodiments.

FIG. 1 shows a schematic illustration of a first exemplary embodiment of a circuit arrangement according to the invention. A DC supply voltage, which can represent the so-called intermediate circuit voltage $U_{Zw}$ derived from an AC system voltage, is applied between a first input terminal E1 and a second input terminal E2 of the circuit arrangement. The series circuit including a first electronic switch Q1 and a second electronic switch Q2 is coupled between the input terminals E1, E2 as part of an inverter, with a first bridge center point BM1 being formed between the switches Q1, Q2.

A lamp inductor $L_{Dr}$ is coupled between the first bridge center point BM1 and a first output terminal A1. In addition to the output terminal A1, a second output terminal A2 is provided for the high filament W1 of a discharge lamp LL. Output terminals A3, A4 are provided for the low filament W2. A coupling capacitor $C_{HB}$ is coupled between the output terminal A3 and the reference potential, which in this case is represented by the input terminal E2. A starting capacitor $C_Z$ which is designed to start the discharge lamp LL together with the lamp inductor $L_{Dr}$, is coupled in parallel with the series circuit including the discharge lamp LL and the coupling capacitor $C_{HB}$.

A direct current source $I_{DC}$, which is fed from the intermediate circuit voltage $U_{Zw}$, provides a current I at its output which is supplied to the discharge lamp LL via the terminal A3. According to various embodiments, a temperature sensor $S_\theta$ is provided which is coupled to a control apparatus 10 for controlling the direct current source $I_{DC}$. Moreover, the control apparatus 10 is coupled to a dimming factor provision apparatus 12. As can be seen from the graph in the dimming factor provision apparatus 12, said apparatus delivers an "ON" signal to the control apparatus 10 at low dimming factors, with the result that said control apparatus instructs the direct current source $I_{DC}$ to set the current I output thereby to zero at temperatures below a threshold value $\theta_1$. At high dimming factors (see "OFF" in the graphs relating to the control apparatus 10 and the dimming factor provision apparatus 12 in FIG. 1), on the other hand, the dimming factor provision apparatus 12 instructs the control apparatus 10 to continue to feed a current I which is greater than zero into the discharge lamp LL via the terminal A3.

Accordingly, a current I is supplied to the discharge lamp LL at high dimming factors in order to prevent striated discharges. At low dimming factors and high temperatures, a current I is still supplied to the discharge lamp, whereas at low dimming factors, e.g. below a threshold value for the dimming factor, and in the case of a reduction in the temperature below the threshold value $\theta_1$, the current output by the direct current source is set to zero. As a result, the intrinsic flicker of the discharge lamp LL can be prevented in a reliable manner.

Figure 2:
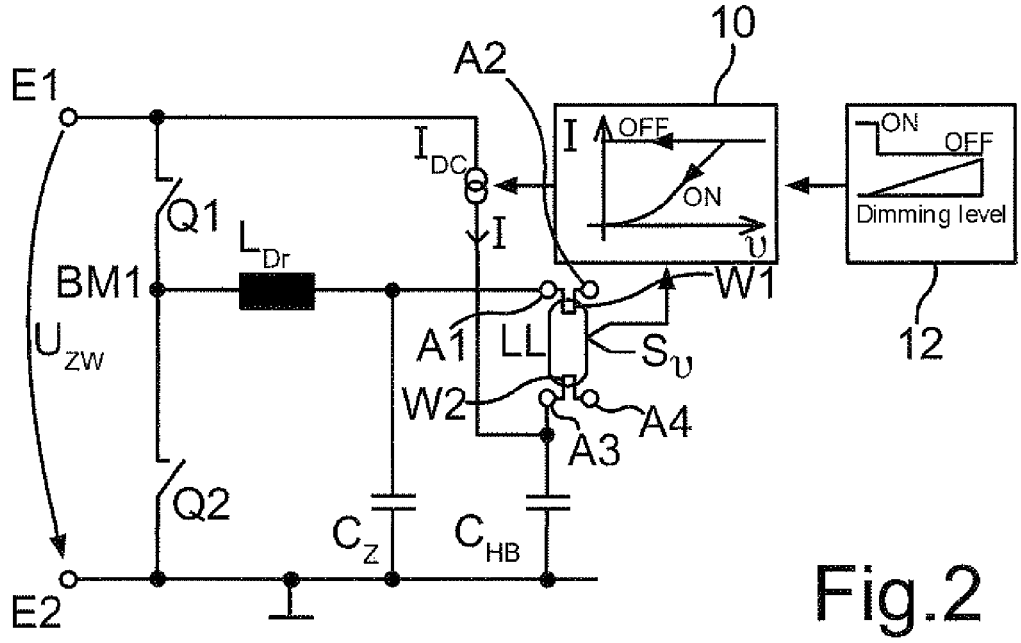
FIG. 2 shows a schematic illustration of a second embodiment of a circuit arrangement in accordance with various embodiments.

The embodiment illustrated in FIG. 2 is characterized by the fact that the reduction in the current I output by the direct current source $I_{DC}$ at low dimming levels at low temperatures takes place continuously, i.e. there is no binary transition as takes place in the exemplary embodiment shown in FIG. 1. The lower the temperature at the discharge lamp LL becomes, the less direct current I is supplied to the discharge lamp LL. This continues until finally there is no longer a direct current I flowing through the discharge lamp LL. As already mentioned, the decrease in the current I output at the direct current source $I_{DC}$ is only activated at a severely dimmed brightness level. At relatively high dimming settings, on the other hand, this function is switched off and the maximum direct current I optimized with respect to striated discharge is always flowing through the discharge lamp LL.

In the present embodiments shown in FIGS. 1 and 2, the direct current source $I_{DC}$ is arranged between the input terminal E1 and the coupling capacitor $C_{HB}$. Alternatively, it can also be arranged between the terminal A3 and the reference potential. In addition, it can be coupled to the terminal A4, instead of the terminal A3. As is mentioned further below with reference to FIG. 4, the direct current source can also be realized by virtue of the pulse width ratio of the signals used for driving the switches Q1, Q2.

Figure 3:
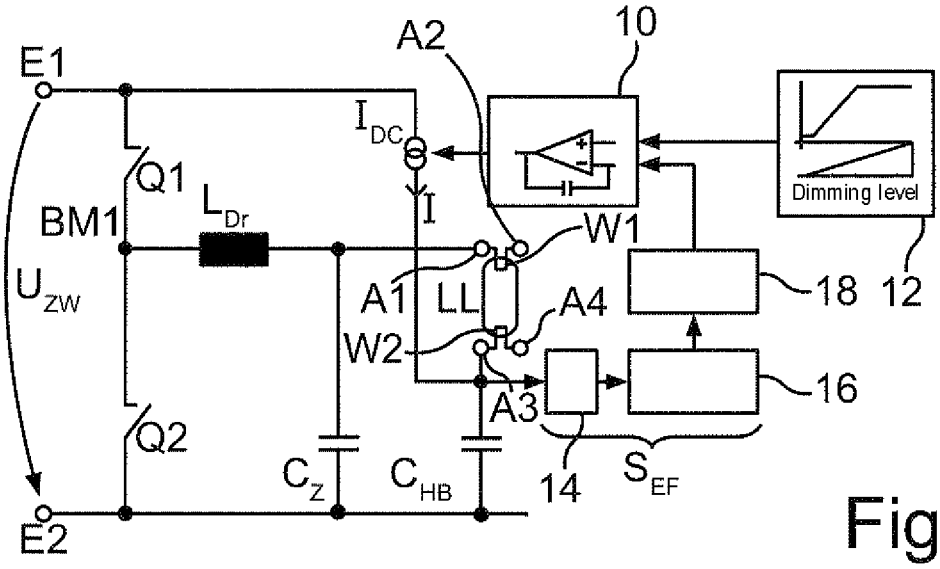
FIG. 3 shows a schematic illustration of a third embodiment of a circuit arrangement in accordance with various embodiments.
Figure 4:
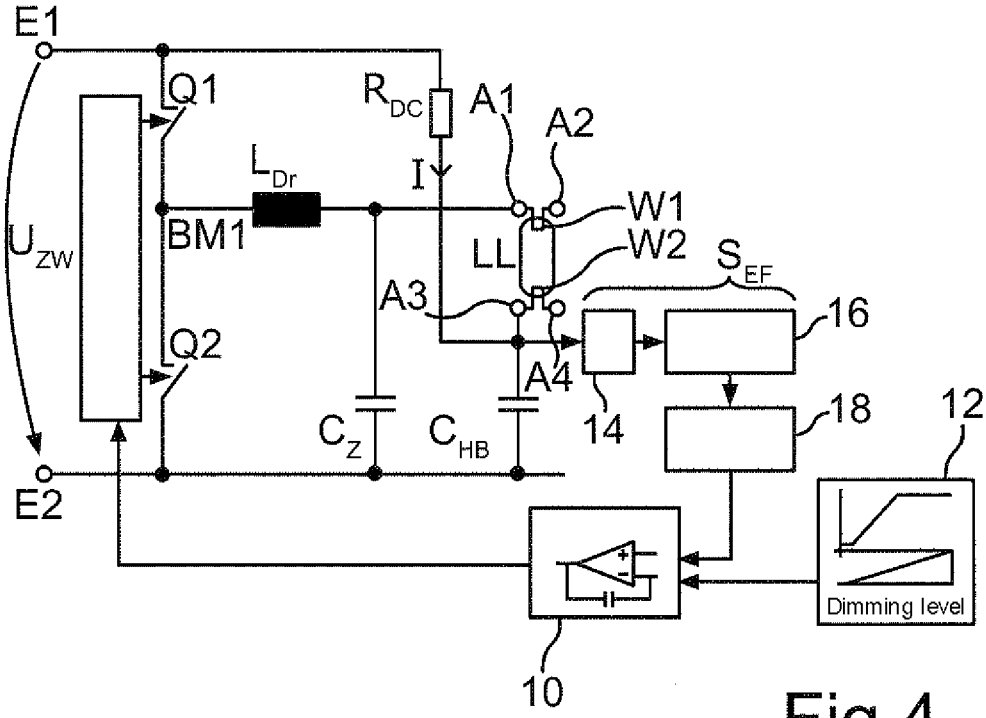
FIG. 4 shows a schematic illustration of a fourth embodiment of a circuit arrangement in accordance with various embodiments.
Figure 5:
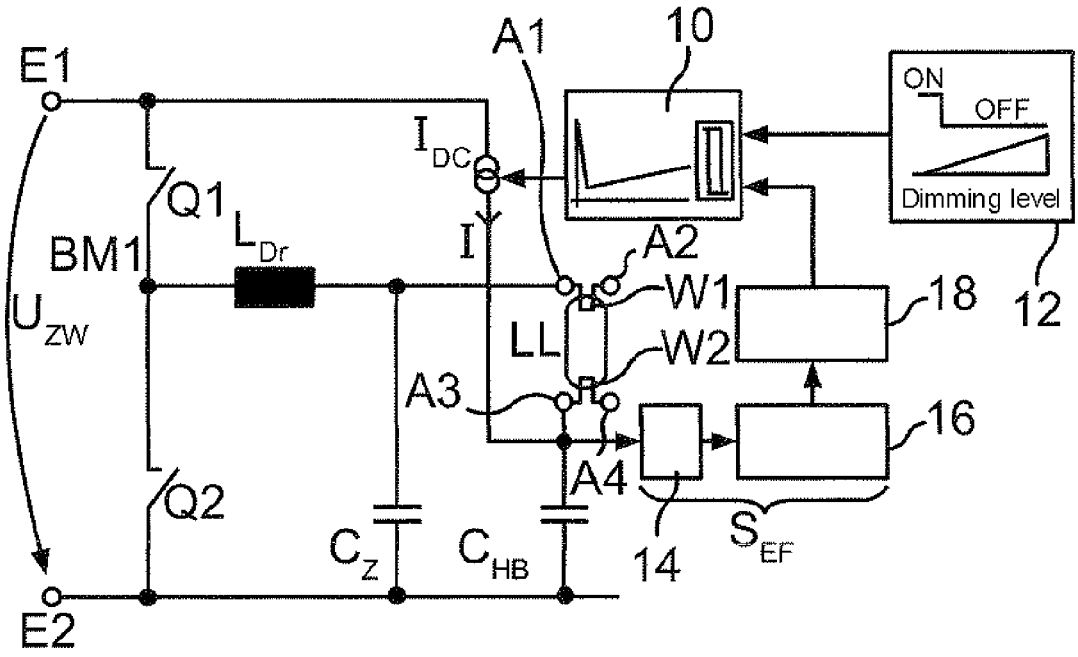
FIG. 5 shows a schematic illustration of a fifth embodiment of a circuit arrangement in accordance with various embodiments.

In the embodiments shown in FIG. 3 to FIG. 5, it is possible to dispense with a temperature sensor $S_\theta$. In this case, the intrinsic flicker of the discharge lamp LL is established by evaluation of the voltage drop across the coupling capacitor $C_{HB}$. For this purpose, a sensor apparatus $S_{EF}$ evaluates the low-frequency AC voltage component, resulting from the intrinsic flicker, of the voltage drop across the coupling capacitor $C_{HB}$. The sensor apparatus $S_{EF}$ includes, for this purpose, a low-pass filter apparatus 14, an AC signal output apparatus 16 and a rectifier 18. The control apparatus 10 includes a closed-loop control apparatus with a first and a second input. The first input is coupled to the output of the rectifier 18, and the second input is coupled to the dimming signal provision apparatus 12, which in this case is in the form of a comparison value provision apparatus. The comparison value provision apparatus 12 provides a comparison value depending on the dimming factor at its output. The lower the dimming factor, the lower the comparison value provided and the greater the effect of intrinsic flicker on the activity of the control loop.

The control apparatus 10 is designed to drive the direct current source $I_{DC}$ in such a way that the amplitude I of the direct current output by the direct current source $I_{DC}$ is varied depending on the signal at the output of the closed-loop control apparatus 10. The closed-loop control apparatus 10 may be in the form of an I controller. In this case, in the embodiment illustrated in FIG. 3, the direct current $I_{DC}$ is only decreased when intrinsic flicker of the discharge lamp LL is established. In the case of discharge lamps which do not demonstrate any intrinsic flicker, the supply of a direct current I is maintained within the entire dimming and temperature range.

The embodiment illustrated in FIG. 4 substantially corresponds to the embodiment illustrated in FIG. 3, but the realization of a direct current source in the embodiment illustrated in FIG. 4 is realized by adjusting the duty factor of the signals driving the switches Q1, Q2 in the bridge circuit. In order to enable this to happen, a nonreactive resistor $R_{DC}$ is inserted between the first input terminal E1 and the coupling point between the terminal A3 and the coupling capacitor $C_{HB}$. Furthermore, the control apparatus 10, which includes the I controller, is coupled to an apparatus 20 for adjusting the duty factor of the signal driving the switches Q1, Q2.

While the control loop is operated at the stability limit in the embodiments shown in FIG. 3 and FIG. 4, and therefore there is the risk of the discharge lamp LL occasionally having very slight intrinsic flicker, this is further reduced in a reliable manner in the embodiment shown in FIG. 5. For this purpose, in the embodiment shown in FIG. 5, the control apparatus 10 is provided with a two-state controller. In the event of the occurrence of intrinsic flicker of the discharge lamp, the current I output by the direct current source $I_{DC}$ is reduced in the milliseconds range until the sensor apparatus $S_{EF}$ no longer detects any intrinsic flicker. Then, the direct current I output by the direct current source $I_{DC}$ is increased slowly, i.e. in the seconds to minutes range, until the intrinsic flicker just occurs again. This renewed occurrence of the intrinsic flicker is identified by the sensor apparatus $S_{EF}$, and the direct current is again reduced quickly.

One advantage of this solution consists in that the control loop always only enters the intrinsic flicker state for a short period of time and the discharge lamp LL is then operated in the state without intrinsic flicker for a long period of time. The time constants for the decrease in and increase in the direct current can be adjusted, with the decrease always taking place more quickly than the increase in direct current. A discharge lamp described in accordance with the exemplary embodiment shown in FIG. 5 is characterized by an extremely steady visual impression.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement for operating at least one discharge lamp, the circuit arrangement comprising:

an input with a first input terminal and a second input terminal for coupling to a DC supply voltage;

a bridge circuit with at least a first electronic switch and a second electronic switch, the first electronic switch and the second electronic switch being coupled in series between the first input terminal and the second input terminal so as to form a first bridge center point of the bridge circuit, and with at least one coupling capacitor;

a first output terminal and a second output terminal for coupling to the high filament of the discharge lamp;

a third output terminal and a fourth output terminal for coupling to the low filament of the discharge lamp;

a lamp inductor, which is coupled in series between the first bridge center point and one of the output terminals for the high filament of the discharge lamp;

a direct current source, which is coupled to the discharge lamp;

at least one sensor apparatus for detecting at least one operational parameter of the discharge lamp; and a control apparatus, which is coupled to the at least one sensor apparatus and the direct current source, the control apparatus being designed to vary the amplitude of the direct current output by the direct current source depending on the at least one operational parameter detected by the at least one sensor apparatus, wherein the at least one sensor apparatus comprises a temperature sensor, and wherein the control apparatus is designed to drive the direct current source in such a way that the amplitude of the direct current output by the direct current source is varied in accordance with a predeterminable characteristic stored in the control apparatus depending on the temperature.

2. The circuit arrangement as claimed in claim 1, further comprising:

a dimming factor provision apparatus, which is designed to provide a signal at its output which is correlated with a dimming factor of the circuit arrangement, the dimming factor provision apparatus being coupled to the control apparatus, the control apparatus being designed to vary the amplitude of the direct current output by the direct current source depending on the dimming factor.

3. The circuit arrangement as claimed in claim 2, wherein the control apparatus is designed to vary the amplitude of the direct current output by the direct current source only when the dimming factor is in a predeterminable range.

4. The circuit arrangement as claimed in claim 2, wherein the control apparatus is designed to vary the amplitude of the direct current output by the direct current source to different extents depending on the dimming factor.

5. The circuit arrangement as claimed in claim 1, wherein the direct current source is coupled between the first input terminal and one of the output terminals for the low filament of the discharge lamp.

6. The circuit arrangement as claimed in claim 1, wherein the direct current source is coupled between one of the output terminals for the low filament of the discharge lamp and a reference potential.

7. The circuit arrangement as claimed in claim 6, wherein the direct current source is coupled between one of the output terminals for the low filament of the discharge lamp and the second input terminal.

8. The circuit arrangement as claimed in claim 1, wherein the direct current source is realized by adjusting the duty factor of the signal driving the switches in the bridge circuit.

9. The circuit arrangement as claimed in claim 1, wherein the temperature sensor is arranged with respect to the discharge lamp in such a way that the temperature sensor can be used to measure a temperature which is correlated with the temperature of the discharge lamp.

10. The circuit arrangement as claimed in claim 1, wherein the characteristic is designed in such a way that the control apparatus drives the direct current source in such a way that said direct current source outputs a direct current of a predeterminable amplitude at a temperature which is equal to or greater than a predeterminable threshold value, and does not output a direct current at a temperature below the predeterminable threshold value.

11. The circuit arrangement as claimed in claim 1, wherein the characteristic is designed in such a way that the control apparatus drives the direct current source in such a way that the amplitude of the direct current output thereby is reduced substantially continuously at relatively low temperatures, or is reduced in accordance with a large number of steps depending on the temperature.

12. The circuit arrangement as claimed in claim 1, wherein the sensor apparatus is coupled to the at least one coupling capacitor, the sensor apparatus being designed to evaluate the voltage drop across the coupling capacitor.

13. The circuit arrangement as claimed in claim 12, wherein the sensor apparatus comprises the series circuit comprising a low-pass filter apparatus, an AC signal output apparatus and a rectifier.

14. The circuit arrangement as claimed in claim 12, wherein the control apparatus comprises a closed-loop control apparatus with a first input and a second input, the first input being coupled to the output of the rectifier, and the second input being coupled to a comparison value provision apparatus, the comparison value provision apparatus being designed to provide a comparison value, in particular depending on the dimming factor, at its output, the control apparatus being designed to drive the direct current source in such a way that the amplitude of the direct current output by the direct current source is varied depending on the signal at the output of the closed-loop control apparatus.

15. The circuit arrangement as claimed in claim 14, wherein the closed-loop control apparatus comprises a two-state controller.

16. The circuit arrangement as claimed in claim 15, wherein the process of increasing the amplitude of the direct current is characterized by a first time constant, and the process of decreasing the amplitude of the direct current is characterized by a second time constant, the first time constant representing a multiple of the second time constant, the first time constant being at least a factor of 1000, preferably at least a factor of 10 000, greater than the second time constant.

17. A method for operating at least one discharge lamp using a circuit arrangement with an input with a first input terminal and a second input terminal for coupling to a DC supply voltage; a bridge circuit with at least a first electronic switch and a second electronic switch, the first electronic switch and the second electronic switch being coupled in series between the first input terminal and the second input terminal so as to form a first bridge center point of the bridge circuit, and with at least one coupling capacitor; a first output terminal and a second output terminal for coupling to the high filament of the discharge lamp; a third output terminal and a fourth output terminal for coupling to the low filament of the discharge lamp; a lamp inductor, which is coupled in series between the first bridge center point and one of the output terminals for the high filament of the discharge lamp; and a direct current source, which is coupled to the discharge lamp; at least one sensor apparatus comprising a temperature sensor; and a control apparatus coupled to the at least one sensor apparatus and the direct current source, the control apparatus being designed to vary the amplitude of the direct current output by the direct current source depending on the at least one operational parameter detected by the at least one sensor apparatus the method comprising:

detecting, by the at least one sensor apparatus at least one operational parameter of the discharge lamp; and varying, by the control apparatus, the direct current output by the direct current source depending on the at least one operational parameter detected by the at least one sensor apparatus; and driving, by the control apparatus, the direct current source in such a way that the amplitude of the direct current output by the direct current source is varied in accordance with a predeterminable characteristic stored in the control apparatus depending on the temperature.

* * * * *